US008074624B2

(12) United States Patent
Hohkita et al.

(10) Patent No.: US 8,074,624 B2
(45) Date of Patent: Dec. 13, 2011

(54) FUEL SYSTEM COMPONENT FOR A DIRECT INJECTION INTERNAL COMBUSTION ENGINE

(75) Inventors: Atsushi Hohkita, Novi, MI (US); Masahiro Soma, Danville, KY (US); Hiroaki Saeki, West Bloomfield, MI (US); Hiroshi Ono, Novi, MI (US)

(73) Assignee: Hitachi Automotive Systems, Ltd., Tokyo (JP)

( * ) Notice: Subject to any disclaimer, the term of this patent is extended or adjusted under 35 U.S.C. 154(b) by 325 days.

(21) Appl. No.: 12/434,702

(22) Filed: May 4, 2009

(65) Prior Publication Data

US 2010/0275883 A1 Nov. 4, 2010

(51) Int. Cl.
*F02M 69/46* (2006.01)
*F02M 69/52* (2006.01)

(52) U.S. Cl. ..... 123/456; 123/470

(58) Field of Classification Search ..... 123/470, 123/456, 447, 467, 468, 469; 239/600; 138/26, 138/30

See application file for complete search history.

(56) References Cited

U.S. PATENT DOCUMENTS

| | | | | |
|---|---|---|---|---|
| 4,286,563 | A * | 9/1981 | Fahim et al. | 123/469 |
| 5,172,671 | A * | 12/1992 | Peters et al. | 123/470 |
| 6,684,860 | B2 * | 2/2004 | Baessler et al. | 123/470 |
| 2010/0012093 | A1 * | 1/2010 | Pepperine et al. | 123/470 |

* cited by examiner

*Primary Examiner* — Mahmoud Gimie
(74) *Attorney, Agent, or Firm* — Gifford, Krass, Sprinkle, Anderson & Citkowski, P.C.

(57) ABSTRACT

A fuel system component for a direct injection internal combustion engine. The component includes a fuel rail and a plurality of direct injection fuel injectors which are rigidly attached to the rail. Each fuel injector has an elongated body as well as a harness assembly extending laterally outward from the elongated body. Each injector is attached to the fuel rail such that, when viewed along an axis of the fuel injector body, the fuel rail overlies at least a portion of the injector body and at least a portion of the harness assembly.

9 Claims, 4 Drawing Sheets

FUEL SYSTEM COMPONENT FOR A DIRECT INJECTION INTERNAL COMBUSTION ENGINE

BACKGROUND OF THE INVENTION

I. Field of the Invention

The present invention relates generally to fuel systems for internal combustion engines and, more particularly, to a fuel system component for a direct injection internal combustion engine.

II. Description of Related Art

Direct injection internal combustion engines have enjoyed increased popularity due to the enhanced efficiency and increased fuel economy of such engines. In a direct injection engine, a fuel injector is positioned in the engine block so that one end of the injector is open to the combustion chamber.

With reference to FIGS. 1 and 2, a prior art fuel injector 10 is shown. The fuel injector 10 includes an elongated body 12 which is mounted within a bore in the engine block so that an end 14 of the fuel injector body 12 is open to the engine combustion chamber. One or more seals 16, furthermore, seal the injector body to the engine block.

The body 12 of the fuel injector 10 is mounted to a fuel rail 18. The fuel rail 18 is pressurized with fuel by a fuel pump and supplies that fuel to the fuel injectors 10 attached to the fuel rail 18. The fuel rail 18, in turn, is typically attached to the engine block by a bracket 20.

Both the timing and duration of the fuel pulses out the end 14 of the fuel injector 10 and into the combustion chamber is controlled by valving contained within the fuel injector 10. In order to actuate that valving, an injector connector 22 is attached to each fuel injector 10. The injector connector 22 includes an elongated injector connector portion 24 as well as a terminal 26 and is connected to the harness assembly. The terminal 26 is electrically connected to the fuel management system for the engine which controls the timing and duration of the fuel injection pulses by electrical signals provided through the terminal 26.

As best shown in FIG. 2, conventionally the injector connector 24 as well as the terminal 26 extends laterally outwardly from the fuel rail 18 when viewed along the axis of the fuel injector body 12. Thus, with the fuel rail 18 overlying the fuel injector body 12, both the injector connector 24 as well as the terminal 26 protrudes laterally outwardly from one side of the fuel rail 18.

The fuel pressures required by a direct injection engine greatly exceed the fuel pressures utilized by the previously known multipoint injectors. Consequently, in order to prevent movement of the fuel injectors 10 in operation, the fuel injector 10 is conventionally rigidly attached to the fuel rail 18 which, in turn, is rigidly attached to the engine block by the injector connector 20.

These previously known direct injection engines, however, suffer from several disadvantages. First, since the fuel injectors 10 are rigidly mounted to tie fuel rail 18, the fuel rail 18, together with its attached fuel injectors 10, must be removed from the engine block as a unit when service is required. However, in some engines, an attempt to remove the fuel rail 18 with its attached fuel injectors 10 creates an interference between the harness assembly 22 and other components in the engine. Consequently, when removal of the fuel rail 18 with its attached fuel injectors 10 is required, partial disassembly of the engine is also required. This, however, disadvantageously increases the overall servicing cost for the engine.

A further disadvantage of the previously known fuel rail and fuel injector components is that the attachment of the bracket 20 to the engine block is offset from the axis of the fuel injector body 12. This, in turn, creates a torque on the fuel injector from the discharge of fuel through the end 14 of the fuel injector body 12. This torque, over time, can create stresses in the components of the fuel injector system. In extreme cases, these stresses may result in fracture, cracking or other failure of the fuel system components for the direct injection engine.

Summary of the Present Invention

BRIEF DESCRIPTION OF THE DRAWING

A better understanding of the present invention will be had upon reference to the following detailed description when read in conjunction with the accompanying drawing, wherein like reference characters refer to lice parts throughout the several views, and in which.

DETAILED DESCRIPTION OF A PREFERRED EMBODIMENT OF THE PRESENT INVENTION

Figure 3:
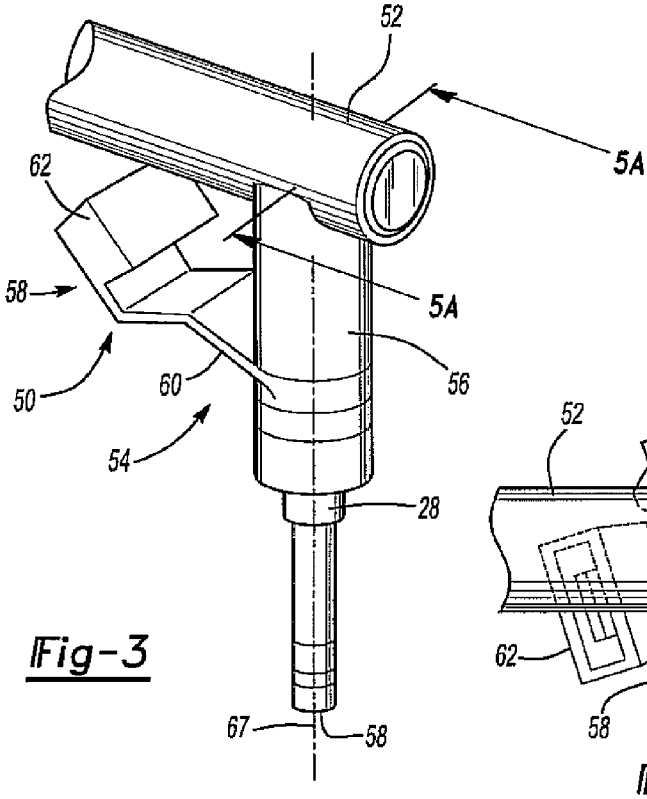
FIG. 3 is an elevational view of a preferred embodiment of the present invention.
Figure 4:
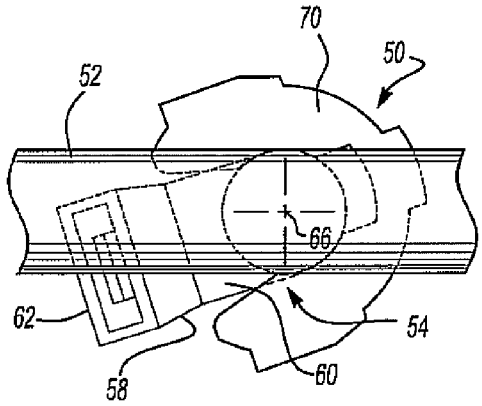
FIG. 4 is a top plan view illustrating a portion of the preferred embodiment of the present invention.
Figure 5A:
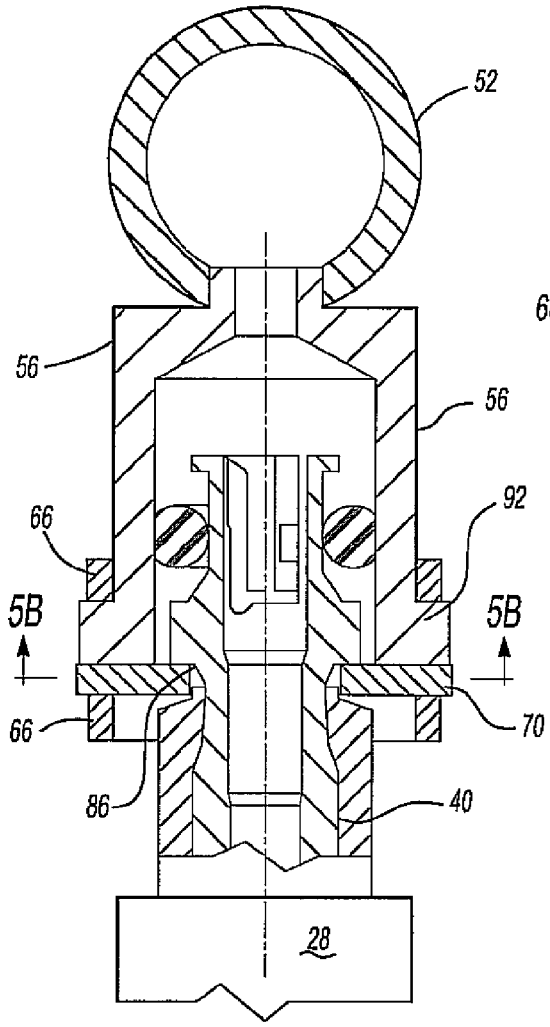
FIG. 5A is a sectional view taken along line 4A-4A in FIG. 3 and enlarged for clarity.
Figure 5C:
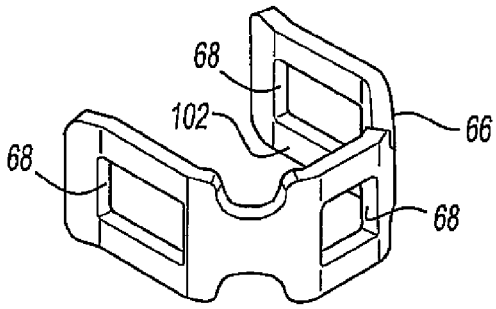
FIG. 5C is an example of the clip holder of the preferred embodiment of the present invention.
Figure 5D:
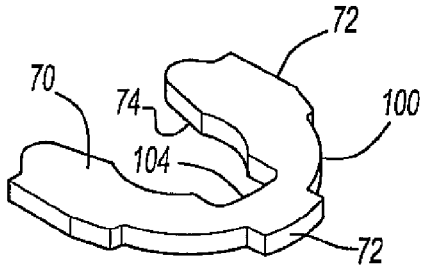
FIG. 5D is an example of the clip plate of the preferred embodiment of the present invention.
Figure 5B:
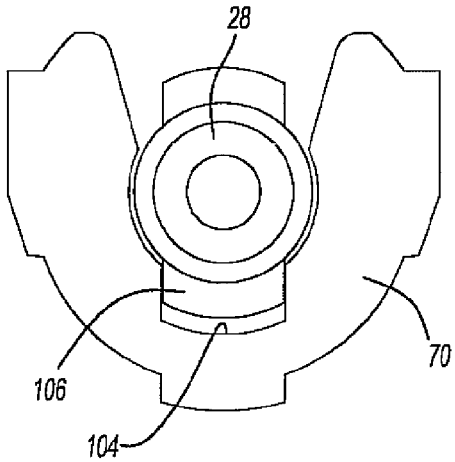
FIG. 5B is a sectional view taken along line 5B-5B in FIG. 5A and enlarged for clarity.

With reference first to FIGS. 3 and 4, a preferred embodiment of a fuel system component 50 is shown. The fuel system component 50 includes a fuel rail 52 adapted to be pressurized with high pressure fuel from a fuel pump (not shown).

A plurality of fuel injectors 54 (only one shown in FIGS. 3 and 4) are attached to and extend outwardly from the fuel rail 52. Each fuel injector 54 includes an elongated fuel injector body 56 open at one end 58. In operation, fuel from the fuel rail 52 passes through the fuel injector body 56, out through the end 58 of the fuel injector body 56 and into the engine combustion chamber.

The fuel injector 54 also includes a connector assembly 58. The connector assembly 58 further includes an injector connector 60 having one end attached to the fuel injector body 56. A terminal 62 is attached to the other end of the injector connector 60.

A control cable (not shown) from the engine control unit is electrically connected to each terminal 62. The engine control unit, through the generation of electrical signals through the terminal 62 and to an electrically controlled valve within the fuel injector 50, controls both the timing and duration of the fuel injection pulses into the engine combustion chamber.

With reference now particularly to FIG. 4, unlike the previously known fuel system components, the injector connector 60 together with the terminal 62 are rotated relative to the fuel rail 52 such that, when viewed along an axis 66 of the fuel injector body 56, the fuel rail overlies at least a portion of the fuel injector body 56 as well as at least a portion of the terminal and injector connector 60.

Figure 6:
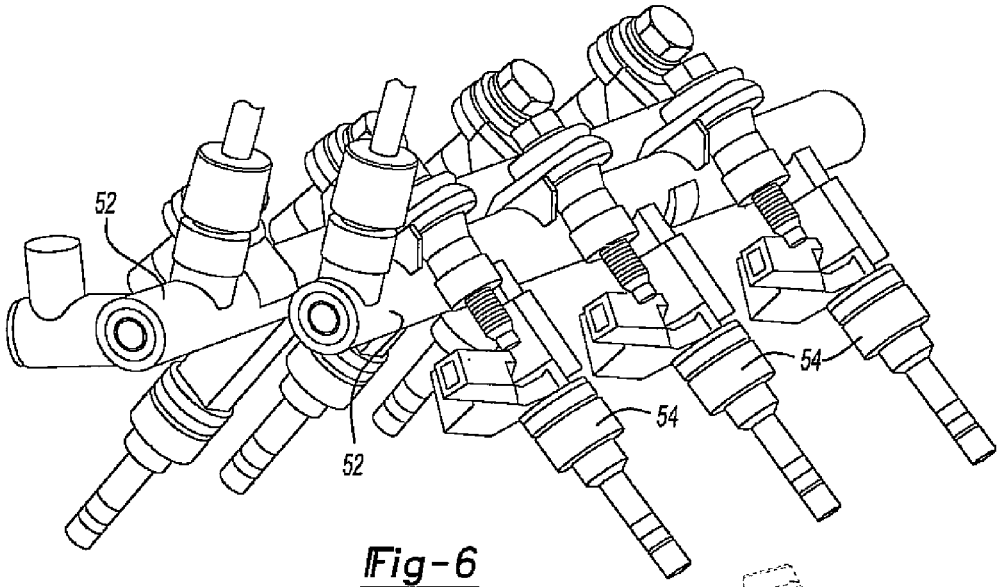
FIG. 6 is an elevational view of a pair of fuel rails for a direct injection engine.
Figure 7:
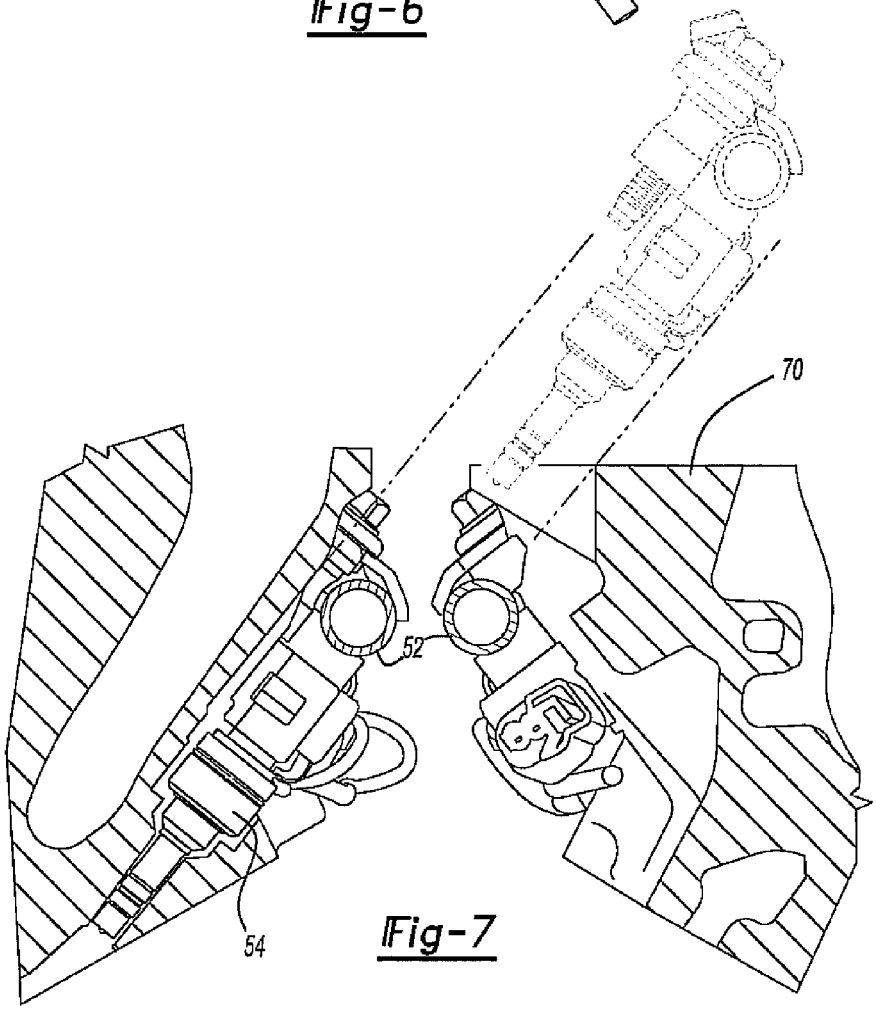
FIG. 7 is a diagrammatic view illustrating the removal of a fuel rail with its attached fuel injectors.

With reference now particularly to FIG. 7, an engine block 70 for a direct injection engine is shown with two side-by-side fuel rails 52, each having a plurality of fuel injectors 54 rigidly attached to the fuel rail 52. As shown in FIG. 6, three fuel injectors are attached to each fuel rail 52, but it will be understood that more or fewer fuel injectors 54 may be associated with each fuel rail 52 without deviation from the spirit or scope of the invention.

Figure 2:
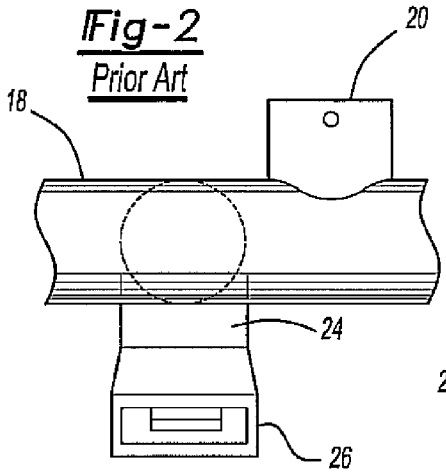
Fig-2 Prior Art
FIG. 2 is a prior art top plan view of a fuel rail with the attached fuel injector.
Figure 1:
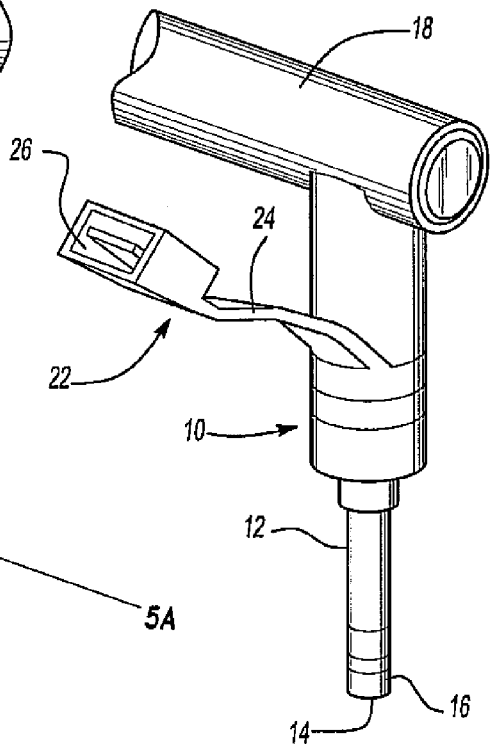
Fig-1 Prior Art
FIG. 1 is an elevational prior art view of a fuel injector attached to a fuel rail 18.

Since the fuel rail 52, when viewed along the axis of the fuel injector body, overlies not only the fuel injector body, but also most of the harness assembly, the entire fuel system component, i.e. the fuel rail 52 with its attached fuel injectors, may be removed as a unit, as indicated in phantom line in FIG. 7, without disassembly of the engine 70. Conversely, if the fuel system components were the conventional fuel system components illustrated in FIGS. 1 and 2 of the drawing, an interference would occur between the harness assembly and other components of the engine upon an attempted removal of the fuel system component. This interference, however, is eliminated by tie present invention by rotating the fuel harness assembly underneath the fuel rail 52 as perhaps best shown in FIG. 4.

With reference now to FIGS. 5A-D, in order to actually attach the fuel injector tip 28 to the injector cup 50, the injector cup 50 includes at least two, and preferably three, outwardly extending tabs 92 at spaced positions around the outer periphery of the injector cup 50. An injector clip holder 66 includes a plurality of spaced openings 68 which are dimensioned to receive the injector cup tabs 62 therethrough. The injector clip holder 66, constructed of a rigid material, is firmly secured to the injector cup 50 once the tabs 62 are positioned through the openings 68 in the clip 66. The holder assembly further comprises an injector clip plate 70, best shown in FIG. 5D. The clip plate 70 is generally planar in construction and includes a plurality of outwardly extending protrusions 72 at spaced intervals around its periphery. The clip plate 70 is constructed of a rigid material, and includes a cutout 74 designed to fit around a portion of the main body 40 of the fuel injector tip 28. Consequently, in operation, the clip holder 66 secures the clip plate 70 to the injector cup 50 which, in turn, is secured to the fuel rail 32. The clip plate 70 supports the abutment surface 86 of the fuel injector tip 28 so that the holder assembly 20 together with the injector cup 50 suspends the fuel injector tip 28 from the fuel rail 32.

Figure 8:
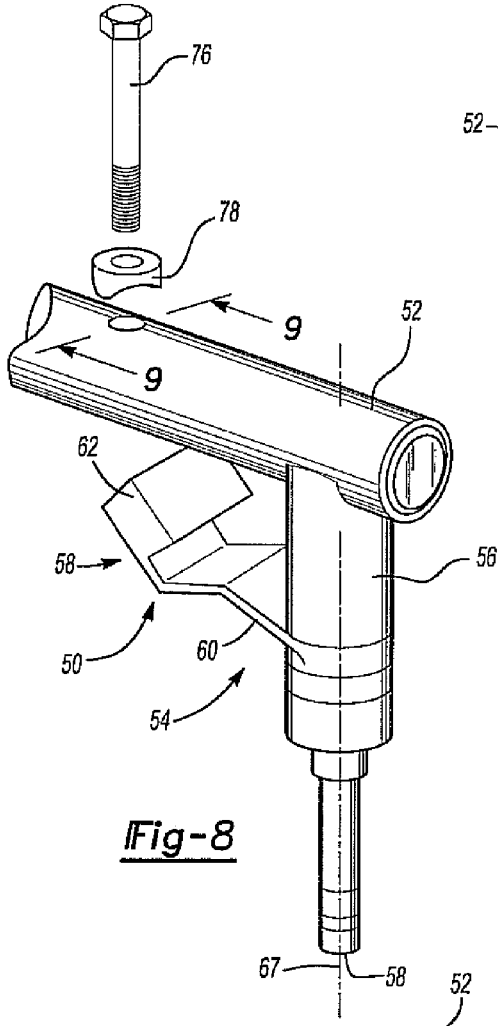
FIG. 8 is a top plan view illustrating a portion of the preferred embodiment of the present invention.
Figure 9:
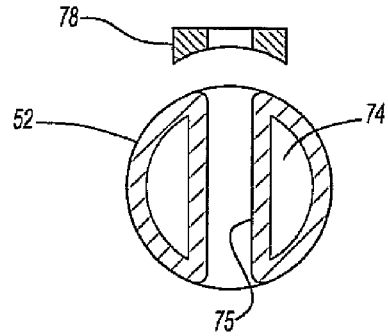
FIG. 9 is a sectional view taken along line 5-5 in FIG. 8 and enlarged for clarity.
Figure 10:
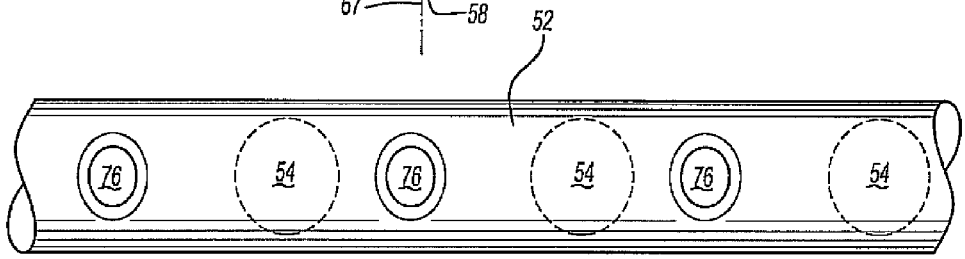
FIG. 10 is a schematic illustration illustrating the position of the bolts and injectors in FIG. 8.

FIGS. 8-10 disclose a modified version of this invention. With reference now to FIGS. 8 and 9, in order to reduce the torsional force imposed on the fuel system component, a mounting passageway 75 is formed through the fuel rail 52. This mounting passageway 75 is fluidly isolated from a fuel chamber 74 within the fuel rail 52 which contains the pressurized fuel from the fuel pump.

In order to attach the fuel rail 52 to the engine block 70, a bolt 76 extends through both a shaped washer 78 and the mounting passageway 72 and into a threaded bore (not shown) on the engine block 70. As shown in FIG. 10, the bolts 76 are aligned between the injectors 54. This structure having the bolts 76 and injectors 54 lined in a straight line will allow easier installation and replacing. It is also effective for suspended injectors, since would lower the power inflicted to the injector body 56. If the bolts 76 and the injectors 54 are not provided on the same line a moment vertical against the fuel pressure direction would be created, thus creates extra pressure to the injector body. Suspended type injectors described in Ser. No. 12/166,760, which is incorporated by reference in this application, have a structure that the fuel injector is suspended from the fuel rail and is connected by clip holder and clip plates. The clip set will work to balance the power inflicted by connector assembly 58 against the fuel injector 54, so that the power reduces in the plane parallel to the fuel rail.

Having described my invention, it can be seen that the present invention provides a simple, yet highly effective construction for a fuel system component of a direct injection engine which facilitates maintenance and other service on the fuel system component.

Having described my invention, however, many modifications thereto will become apparent to those skilled in the art to which it pertains without deviation from the spirit of the invention as defined by the scope of the appended claims.

We claim:

1. A fuel system component for a direct injection internal combustion engine comprising:

an elongated fuel rail, said rail having an elongated fuel passageway, a plurality of direct injection fuel injectors, each fuel injector having an elongated body and a connector assembly extending laterally outwardly from said elongated body, wherein said fuel passageway of said fuel rail is elongated and extends between said fuel injectors, each said injector being attached to said fuel rail such that, when viewed along said axis of said fuel rail, said fuel rail overlies at least a portion of said injector body and at least a portion of said connector assembly and so that a longitudinal axis of each fuel injector intersects said fuel passageway of said fuel rail.

2. The fuel component as defined in claim 1 wherein said connector assembly comprises an injector connector and a terminal, said fuel rail overlying at least a portion of said terminal.

3. The fuel component as defined in claim 2 wherein said injector connector is elongated having one end attached to said injector body and said terminal being attached to the other end of said injector connector.

4. The fuel component as defined in claim 1 wherein said fuel rail and said fuel injectors are rigidly secured together.

5. The fuel component as defined in claim 1 wherein said fuel rail defines an internal chamber adapted to receive pressurized fuel, said fuel rail including a mounting passageway extending through said fuel chamber, said mounting passageway being fluidly isolated from said fuel rail internal chamber and open at each end.

6. The fuel component as defined in claim 1 wherein said fuel rail overlies most of said injector body and most of said connector assembly.

7. The fuel system component as defined in claim 1, further comprising:

a plurality of bolts to attach the fuel rail to an engine block;

wherein said plurality of bolts and said plurality of direct injection fuel injectors are aligned in a single direction.

8. The fuel system component as defined in claim 1, wherein each of said fuel injector included an injector cup, a fuel injector tip portion, and a clip set to hold the injector cup and the fuel injector tip portion.

9. The fuel system component as defined in claim 8, wherein each of said clip set includes a clip plate and a clip holder, said clip holder is positioned so that the power inflicted by the connector assembly against the fuel injector reduces in the plane parallel to the fuel rail.

* * * * *